US006649213B2

(12) United States Patent
Debikey et al.

(10) Patent No.: US 6,649,213 B2
(45) Date of Patent: Nov. 18, 2003

(54) METHODS AND COMPOSITIONS FOR PREVENTING ADVERSE EFFECTS OF WATER UPON A PRINTED SUBSTRATE

(76) Inventors: George Debikey, 6041 Maren Dr., Indianapolis, IN (US) 46224; Michael Pohlad, 2427 Buttrick SE., Asa, MI (US) 49301

( * ) Notice: Subject to any disclaimer, the term of this patent is extended or adjusted under 35 U.S.C. 154(b) by 0 days.

(21) Appl. No.: 09/990,675

(22) Filed: Nov. 16, 2001

(65) Prior Publication Data

US 2002/0058111 A1 May 16, 2002

Related U.S. Application Data

(60) Provisional application No. 60/249,113, filed on Nov. 16, 2000.

(51) Int. Cl.[7] ..... B05D 3/02

(52) U.S. Cl. ..... 427/161; 427/356; 427/368; 427/385.5; 427/391; 427/411; 427/412.1

(58) Field of Search ..... 427/161, 355, 427/356, 368, 385.5, 391, 411, 412.1

(56) References Cited

U.S. PATENT DOCUMENTS

| | | | |
|---|---|---|---|
| 2,934,509 | A | 4/1960 | Crissey et al. |
| 3,175,989 | A | 3/1965 | Cannon et al. |
| 3,701,746 | A | 10/1972 | Johnson et al. |
| 4,118,437 | A | 10/1978 | Parekh |
| 4,197,227 | A | 4/1980 | Zeliger |
| 4,210,567 | A | 7/1980 | Kösters |
| 4,254,235 | A | 3/1981 | Turpin |
| 4,255,558 | A | 3/1981 | Turpin |
| 5,132,377 | A | 7/1992 | Nakano et al. |
| 5,155,154 | A | 10/1992 | Krummel et al. |
| 5,298,542 | A | 3/1994 | Nakamura et al. |
| 5,306,755 | A | 4/1994 | Yau et al. |
| 5,324,762 | A | 6/1994 | Overend et al. |
| 5,326,827 | A | 7/1994 | Aoki et al. |
| 5,441,994 | A | 8/1995 | Moriga et al. |
| 5,475,056 | A | 12/1995 | Koesters et al. |
| 5,521,239 | A | 5/1996 | Handl |
| 5,700,858 | A | 12/1997 | Deir et al. |
| 5,703,198 | A | 12/1997 | Twigt et al. |
| 5,783,626 | A | 7/1998 | Taylor et al. |
| 5,830,937 | A | 11/1998 | Shalov et al. |
| 6,000,793 | A | 12/1999 | Inamoto |
| 6,036,993 | A | 3/2000 | Frazzitta |

FOREIGN PATENT DOCUMENTS

| | | |
|---|---|---|
| DE | 24 54 235 | 5/1976 |
| DE | 39 03 669 | 7/1990 |
| EP | 0 342 562 | 11/1992 |
| JP | 57-38870 | 3/1982 |
| JP | 4-46974 | 2/1992 |
| SU | 979551 | 12/1982 |
| WO | WO 00/12303 | * 3/2000 |

OTHER PUBLICATIONS

Material Safety Data Sheet for DEGALAN® 4899F, Nov. 12, 1999.
Technical Data Sheet for Palatinol® 711P, Oct. 1996.
Material Safety Data Sheet for Palatinol® Plasticizer 711P, Jan. 22, 2000.
Product Information for Syloid® C 907, Jul. 20, 1998.
Material Safety Data Sheet for Tinuvin 1130, Nov. 30, 1998.
Product Information Sheet ofr Tinuvin® 292, Nov. 5, 1998.
Material Safety Data Sheet for Tinuvin® 292, Jan. 24, 2000.
Product Information for Rohamere® 4899–F, Oct. 19, 1995.
Material Safety Data Sheet for Anti–Terra–U 80, Jul. 13, 1999.
Product Information Sheet for Xyron® HeatFree Laminating & Stickermaker, printed from Internet Apr. 19, 2002; http://www.heatfree.com/.

* cited by examiner

*Primary Examiner*—Erma Cameron
(74) *Attorney, Agent, or Firm*—Woodard, Emhardt, Moriarty, McNett & Henry LLP

(57) ABSTRACT

In accordance with the invention, there are provided methods for affixing a transparent coating upon a substrate, such as canvas, paper, cardboard or the like, that optionally has an image printed or otherwise recorded thereon, the coating effective to repel water and to prevent smearing or running of inks that are not water-fast, such as, for example, water-based inks used in ink-jet printers. In accordance with the invention, a coating composition including a particulate thermoplastic resin a plasticizer and, optionally, one or more of a wetting agent, a light stabilizer, an ultraviolet light absorber and a flatting agent is applied on the substrate and heated to cure the composition to a transparent, flexible, water-impervious coating.

27 Claims, No Drawings

METHODS AND COMPOSITIONS FOR PREVENTING ADVERSE EFFECTS OF WATER UPON A PRINTED SUBSTRATE

REFERENCE TO RELATED APPLICATION

The present application claims the benefit of U.S. Provisional Application Ser. No. 60/249,113, entitled METHODS AND COMPOSITIONS FOR PREVENTING ADVERSE EFFECTS OF WATER UPON A PRINTED SUBSTRATE, filed Nov. 16, 2000, which is hereby incorporated by reference herein in its entirety.

BACKGROUND OF THE INVENTION

The present invention relates to transparent coatings for substrates. More particularly, the invention relates to transparent coatings that protect substrates from the adverse effects of contact with water. Yet more particularly, the invention relates to a transparent coating for a substrate, such as canvas, paper, cardboard or the like, that has an image printed or otherwise recorded thereon, the coating effective to repel water and to prevent smearing or running of inks that are not water-fast, such as, for example, water-based inks used in ink-jet printers. In accordance with the invention, a transparent coating is affixed on the substrate such that the coating provides a water-impervious protective barrier over the substrate.

By way of background, a great deal of attention has been given in recent years to improving and developing new compositions, devices and methods for printing or otherwise recording high quality characters, images and the like on substrates such as canvas, paper, cardboard, and the like. Particularly notable is technology involving ink-jet recording techniques. An ink-jet recording system (also referred to herein as an "ink-jet printer") is a recording system in which fine ink droplets are formed by one of various methods, and the ink droplets are directly applied to a recording medium such as paper.

In an ink-jet printer, liquid ink is ejected onto a recording medium as flying particles from nozzles (orifices) of a very small diameter, so that flying particles of the ink adhere onto the recording medium to thereby form characters, images and the like. Ink-jet printing therefore involves placement, in response to a digital signal, of small drops of a fluid ink onto a surface to form an image without physical contact between the printing device and the surface.

An ink-jet recording technique is advantageous in that less noise is generated during recording compared to other recording techniques, and images of high resolution are obtained at a high speed by using heads with a high degree of integration. Indeed, this ability to produce high resolution images, in combination with the capabilities of modern computers to facilitate the creation and duplication of images digitally, has led to the widespread use of ink-jet printers in the production and reproduction of artwork. A form of artwork that has become extremely popular of late involves giclee printing, in which a computer image of a work of art is made and then printed onto canvas, paper, cardboard or the like using a high quality ink-jet printer. Pieces made in this manner are then often sold, optionally with the artists signature thereon. Works of art, including paintings, sketches and other art forms can be converted to a digital file, for example, using a scanner, and then printed using an ink-jet printer to make replicas of the artwork. Alternatively, artwork can be created originally using a computer and then can be printed in a similar manner.

The method of drop generation varies among the different ink-jet technologies and can be used to classify ink-jet printing into two major technology types, continuous (CIJ) and drop-on-demand (DOD). In DOD printing systems, liquid ink droplets are propelled from a nozzle by heat (thermal or bubble ink-jet) or by a pressure wave (piezo ink-jet). All the ink droplets are used to form the printed image and are ejected as needed, "on demand." Thermal or bubble jet inks typically are based on water and glycols. In CIJ printing systems, a continuous stream of liquid ink droplets is ejected from a nozzle and is directed, with the assistance of an electrostatic charging device in close proximity to the print head, either to a substrate to form a printed image or to a recirculating system.

Presently, the most common ink-jet recording techniques employ, as a recording liquid, ink that is prepared by dissolving various water-soluble dyes in water or a mixture of water and an organic solvent. The following properties of such an ink composition are desired:

(a) high quality printing (edge acuity and optical density) of text and graphics on substrates, (b) short dry time of the ink on a substrate such that the resulting printed image is not smudged when rubbed or offset onto a subsequent printed image placed upon the print, (c) good jetting properties exhibited by a lack of deviation of ink droplets from the flight path (misplaced dots) and of ink starvation during conditions of high ink demand (missing dots), (d) resistance of the ink after drying on a substrate to water and to abrasion, (e) long-term storage stability (no crust formation or pigment settling) and (f) long-term reliability (no corrosion or nozzle clogging).

Often, the inclusion of an ink component meant to satisfy one of the above goals could have a detrimental impact upon another. For example, the inclusion of an aqueous resin or other polymer in the ink composition can improve the water resistance of the ink on a substrate after drying and the affinity of pigments to the substrate. In this regard, the use of lignin binders in ink-jet inks has been described. It has been reported that unmodified lignin may be used in conjunction with other polymers in such an ink. However, the addition of a polymer sufficient to fix the pigments on the substrate increases the viscosity of the recording liquid, and problems in practicality of ink discharge stability arise due to the increase in energy required for ink discharge of the inkjet. In addition, the polymer can cause a reduction in the print quality and optical density, as well as impair jetting properties and long-term storage stability. Thus, most commercial ink-jet inks represent a compromise in an attempt to achieve at least an adequate response in meeting the above listed goals.

An ink-jet printer generally employs inks of the type obtained by dissolving various dyestuffs in water or in an organic solvent. Water-based inks containing water-soluble recording agents are used in many ink-jet printers because they have suitable ejection and printing characteristics and because they have desirable characteristics from the viewpoints of safety, odor and the like. These inks are typically composed of a water-soluble dye or pigment, a water-soluble organic solvent (anti-crusting agent) used for preventing clogging by drying within an ejection nozzle, water, and optional components such as a penetrant, a dye-dissolving aid and a mildew-proofing agent. Since water soluble dyes with high solubility in water are generally used, the water resistance of the inkjet recorded materials is generally low and the dye on the recorded material may be easily smudged when water is spilled onto it. The use of water-soluble dyes, therefore, often causes a problem in water resistance of recorded images owing to the fact that the ink is water-soluble. In other words, if recorded images are moistened with rain, sweat or drinking water, they are likely to smear, blot, blur or disappear.

A wide variety of attempts have been made to address the problem of smearing and running ink that occurs when a recorded image generated using a water-based ink is contacted by water or other elements. For example, attempts have been made to improve the inferior water resistance by changing the structure of the dye or preparing recording liquid with high basicity. Also, attempts to improve water resistance by causing a reaction between the recording paper and recording liquid have been made. These methods have made remarkable effects for special recording papers but lack versatility in that they are limited to special recording papers and, quite often, the water-resistant quality of the recorded material is insufficient when recording papers other than those specially prescribed are used.

Other attempts to address the problem of smearing and running ink that occurs when a recorded image is contacted by water or other elements involve the placement of a barrier layer over the image. Examples include dry mounting, or laminating, which includes adhering a preformed plastic film over the image, and application of various volatile solvent-based compositions over the image. Such attempts, however, suffer from numerous disadvantages, including, for example, high labor requirements; requirements for large and expensive equipment; difficulty achieving good quality, especially for large images; significant health and environmental implications relating to the use of volatile, often toxic, solvents; and the like.

There is a continuing need for further developments in the field of printed images, especially ink-jet printed images, to improve the water fastness of printed images. The present invention addresses this need.

SUMMARY OF THE INVENTION

Provided by the present invention are compositions and techniques for protecting a substrate by placing a transparent, water-impervious coating over the substrate.

One form of the present invention is a unique composition that can be applied to a surface and heated to provide a transparent, water-impervious coating.

A further form of the present invention includes a technique for protecting a substrate by applying a viscous heat-curable composition to the substrate and heating the composition to provide a transparent, water-impervious coating on the substrate.

Further forms, embodiments, objects, features, and aspects of the present invention shall become apparent from the description contained herein.

DETAILED DESCRIPTION OF THE PREFERRED EMBODIMENTS

For the purpose of promoting an understanding of the principles of the invention, reference will now be made to preferred embodiments and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

In accordance with the present invention, a coating composition prepared and/or selected in accordance with the invention is applied to a substrate, and then heat-cured to provide a transparent, water-impervious coating on the substrate. The term "coating composition" is used herein to refer to a fluid composition that can be applied to a substrate and cured in accordance with the invention. The coating composition is a nonaqueous composition ranging in viscosity from a pourable liquid to a heavy paste, and includes a particulate polymer dispersed or suspended in a nonvolatile liquid organic plasticizer material that is compatible with the polymer. The term "coating" is used to describe a layer or film that remains on the substrate surface after deposition and curing of the coating composition.

A coating composition of the present invention can be use in connection with a wide variety of products that require protective coatings or layers, and the present invention provides coating compositions that are especially well adapted to act as surface coverings for various substrate surfaces. In a preferred aspect of the invention, coating compositions are used to provide surface coverings for a substrate having a printed image thereon, such as, for example, canvas, paper, cloth, cardboard, and the like, especially those printed with a non waterfast ink, such as, for example, ink-jet ink.

In one aspect of the invention, an ink layer is first put down on a substrate in the form of canvas, paper, cloth, fiberboard, corrugated box, etc. After the ink layer is put down on the substrate, a coating composition prepared or selected in accordance with the invention is applied to the substrate and the coating composition is exposed to heat to convert the coating composition to a transparent, flexible, water-impervious coating. In one embodiment of the invention, the ink layer is allowed to dry prior to applying the coating composition. In another embodiment, the coating composition is applied before the ink layer is dry.

The coating composition is preferably applied to the substrate or a portion of the substrate in a substantially even layer. The step of applying the coating composition to the substrate may comprise any one of a variety of techniques commonly employed for coating a liquid onto a surface. For example, the coating composition can be applied using a direct roll coater, a squeegee, a brush, a pallet knife, a spraying device or the like. In one inventive method, wherein the substrate/ink layer is an ink-jet reproduction of a painting (also referred to herein generally as a "print"), the coating composition is applied to the print using a brush, such as, for example, an artist's brush. By applying the coating composition in this way, the layer of coating composition can be textured using the brush to give an original-painting appearance. In another manner of applying an inventive coating composition, a bead of the coating composition is placed on a print, and the bead is spread over the print using a squeegee or other type of roll coater, covering the entire image or a desired portion of the image. If a relatively smooth surface is desired, the coating composition can be cured after spreading the coating composition to provide a relatively smooth coating on the substrate. Alternatively, if desired, a brush or pallet knife can be used to add texture to the coating composition prior to curing. For example, to impart a brush stroke surface to the coating composition, a brush, such as, for example, an artist's brush, can be used to make brush stroke marks in the coating composition. Similarly, if a stucco-type surface is desired, a pallet knife can be contacted to the surface of the coating composition and pulled away to make stucco marks in the coating composition. It is to be understood that alternative designs and/or textures can be achieved using other techniques known and available in the art. In these manners, an authentic-looking replica of a painting can be made using ink-jet technology and using a coating composition of the present invention.

In one embodiment, the coating composition is applied at an average thickness of from about 0.0005 inch to greater than about 0.025 inch. In another embodiment, a less viscous coating composition, such as, for example, a coating composition having a viscosity of from about 100 to about 800 poise as measured by a Brookfield RVT viscometer, 2.5 rpm, spindle #7, at room temperature, can be applied in thicknesses ranging from about 0.001 to about 0.005 inch.

Once applied to the substrate, the coating composition is exposed to heat to convert the coating composition to a durable transparent, flexible, water-impervious coating. The presence of such a coating as the topcoat on a printed product, and particularly a product printed using a non waterfast ink-jet ink, protects the product, and contributes significantly to the value of such product.

It is to be understood that the thickness of the coating composition over the substrate can effect the length of time necessary to cure the coating composition. While it is not intended that the invention be limited by any theory, it is believed that the time period and temperature necessary for proper curing are related to the time necessary for heat to penetrate the thickness of the coating composition and to maintain the coating composition at an effective temperature for a length of time necessary to achieve curing. It is of course possible, and in some cases desirable, to apply the coating composition at varying thicknesses over a single substrate.

The substrate with the coating composition thereon can be heated in an oven or other suitable heating device for a period of time and under temperature conditions sufficient to gel and fuse the coating composition, but not so great to result in the decomposition or charring of materials present. For many embodiments of the invention, curing is achieved by heating the coating composition to a temperature of at least about 200° F., more preferably at least about 250° F. It is of course understood that the temperature should not exceed a temperature that damages, decomposes or chars a component of the coating composition or a component of the substrate. For many embodiments of the invention, heating the coating composition to a temperature of from about 250° F. to about 280° F. for a time period of up to about 15 minutes is effective to achieve curing. It is to be understood that the time period can be relatively shorter where the coating composition is applied relatively thinly, and the time period can be relatively longer if the coating composition is applied at a relatively greater thickness. In addition, the appropriate cure time can also vary in accordance with different coating composition formulations. It is within the purview of a person of ordinary skill in the art to select an appropriate temperature and cure time without undue experimentation for a given coating composition and a given thickness.

In other methods according to the present invention, the coating may simply be placed onto an uninked or ink-free substrate. The coating serves to provide certain film characteristics including gloss or matte, mar resistance, oil and water resistance, protection of the inked, uninked or related surface, and other characteristics. In addition, a current trend in the field of fine art print reproduction is to make prints having a sepia tint or tone, for example ranging from a brownish gray to a dark olive brown tint or tone. It is believed that such sepia-toned prints are popular because such a tint or tone lends to the print an aged appearance, which is currently popular among purchasers or prospective purchasers of such prints. Also gaining in popularity are prints having alternative tints or tones, such as, for example, rose tints or tones or greenish tints or tones. As such, in certain embodiments of the invention the coating composition includes a tinting or toning agent, such as, for example but without limitation, a controlled amount of dye, provided that the tinting or toning agent is not of a type and/or not present in a quantity that eliminates or substantially impairs the transparency of the post-cure coating.

In another embodiment of the invention, the coating composition is used to provide a barrier coating over products that come into contact with food items. In the food industry, paperboard having a moisture barrier coating are often used as food trays and related plastic food packaging material. Thus, in another application of the invention, an inventive coating composition is applied to the surface of paperboard to create a surface which can influence the moisture vapor transition rate and lower it to a level which is compatible with the storage of food, especially meat, poultry and other perishable items.

The coating composition includes a particulate polymer dispersed or suspended in a nonvolatile liquid organic plasticizer material which is compatible with the polymer. The polymer is preferably an acrylic polymer. While it is not intended that the present invention be limited by any theory whereby it achieves its advantageous result, it is believed that the polymer remains dispersed or suspended in the plasticizer at ambient temperatures, but on heating the coating composition to an appropriate elevated temperature, the coating composition gels to form a homogenous coalesced mass which retains its homogenous character permanently on cooling. It is believed that the presence of the plasticizer also provides desirable properties to the polymer, particularly workability prior to gelling, and flexibility after gelling. The coating compositions may include other materials, as discussed in greater detail below; however, it is important that the other materials have properties that do not eliminate the transparency of the coating. Substantially uniform, homogeneous suspensions or dispersions of fine polymeric solids in a liquid plasticizer such as those described herein generally take the form of relatively viscous, coatable fluids, such as pastes, and are known as fluid plastisols.

In one embodiment, the particulate polymer is a thermoplastic resin. The polymer particles preferably have a specifically adjusted particle size and a specifically adjusted particle size distribution to impart uniformity to the coating composition. In one preferred embodiment, the polymer particles have an average size of primary particles of from about 50 to about 100 $\mu$m. In another embodiment, the polymer particles have an average size of primary particles of from about 65 to about 80 $\mu$m. In another embodiment, the polymer particles have an average size of primary particles of about 75 $\mu$m. In another embodiment, the polymer particles have an average size of primary particles of about 55 $\mu$m.

The thermoplastic polymer component of the present invention can be selected from a wide variety of compounds and, in view of the present disclosure, one skilled in the art is capable of selecting such material for a particular application without undue experimentation. Accordingly, a wide variety of such materials are contemplated for use in accordance with the present invention. In one preferred embodiment, the thermoplastic polymer comprises polymeric particles that are readily combinable with the plasticizer to form a smooth, stable fluid plastisol paste. It is also important that the polymer be of a type that, when cured, forms a coating that is transparent. It is within the purview of a person of ordinary skill in the art to identify such polymers without undue experimentation.

In one embodiment, the thermoplastic polymer is an acrylic polymer. The term "acrylic polymer" is used herein to refer to a poly(methyl methacrylate) polymer or a related (meth)acrylate or acrylate copolymer. The term "(meth) acrylate or (meth)acrylic" is used herein to describe a monomer, polymer or copolymer which is or is derived from acrylic acid, methacrylic acid, esters of these acids or mixtures thereof. It is understood that acrylic polymers of different sizes, and different types of acrylics, may be selected and the acrylic polymer selected can have an affect on the rheological characteristics of the coating composition and the curing temperature of the coating composition. Such characteristics can be readily determined by a person of ordinary skill in the art without undue experimentation.

In a preferred aspect of the invention, the thermoplastic polymer is an acrylic polymer based principally either on homopolymers of methyl methacrylate or copolymers of methyl methacrylate with methacrylates of aliphatic C2 to C10 (preferably C2 to C4) alcohols or acrylates of C1 to C10 (preferably C1 to C4) alcohols. In another embodiment, the acrylic polymer particles have a core/shell construction as is known to persons of ordinary skill in the art; the core comprising a plasticizer-compatible homo or copolymer derived from various possible alkyl (≧3 C) acrylates, alkyl (≧2 C) methacrylates, and also styrene, and the shell comprising a plasticizer-incompatible polymer component which is rich in methyl methacrylate (≧80 weight %).

In one embodiment of the invention, acrylic polymers based on methyl methacrylate preferably include copolymerised units of a suitable comonomer, such as an alkyl acrylate or a higher alkyl methacrylate, in order for the acrylic polymer to be acceptably compatible with the plasticizer (i.e. to form a homogeneous gelled mass on heating which is stable on cooling and does not later exude liquid plasticizer). Moreover, to improve the compatibility of such an acrylic polymer with less expensive plasticizers, such as dioctyl phthalate, diisononyl phthalate, diisodecyl phthalate, dioctyl adipate, and diisodecyl adipate, high levels of the comonomer may be incorporated into the methyl methacrylate polymer, e.g. up to about 50 or 60 weight percent.

A preferred thermoplastic polymer for use in accordance with the present invention is DEGALAN 4899-F, commercially available from RÖHM AMERICA, Inc. (Piscataway, N.J.). DEGALAN 4899-F is an acrylic polymer based on n-butyl and methyl methacrylate, and is reported to have a bulk density of 260–300 kg/m$^3$ and a softening point of about 110° C.

As mentioned above, a plasticizer generally functions to increase the workability, flexibility and/or distensibility of the thermoplastic polymeric material of the present invention. As used herein, the term "plasticizer" refers generally to materials and agents adapted to disperse, suspend, or solvate the polymeric material of the present compositions but which are generally nonreactive under the conditions used to cure the present compositions. The term "plasticizer" also refers to a substance or material that is incorporated in the resin in order to increase its workability, flexibility or distensibility.

The plasticizer is selected on the basis of its compatibility with the resin constituent of the composition, that is, its ability to produce a gel, and ultimately a fully fused solid, when the composition is heated. As is well known to those skilled in the art, plasticizers are generally high boiling, chemically and thermally stable organic liquids, low-melting solids or semi-solids. The plasticizer can affect several properties of the present compositions. For example, the plasticizer can have an effect on the rheology of the coating composition as well as on the strength and flexibility of the fused and cured coating. With the guidance provided herein, it is expected that one skilled in the art will be capable of selecting an appropriate plasticizer for a particular application and to produce a coating composition having desired properties without undue experimentation.

In general it is preferred that the plasticizer be readily mixable with the particular thermoplastic polymer to form a homogenous composition which resists exudation of the plasticizer. Furthermore, the plasticizer selected for use in accordance with the invention preferably has the ability to fluidize, solvate, gel and eventually fuse with the thermoplastic polymer. Another desirable property of a plasticizer selected for use in accordance with certain aspects of the present invention is thermal and oxidative stability since such materials can be exposed to high temperatures during processing and use. For this reason anti-oxidants, such as biphenyl A, may optionally be employed in the present compositions.

In one embodiment of the invention, the plasticizer selected for use in an inventive coating composition comprises an ester compound, such as for example but without limitation, a phthalate ester, a dibasic acid ester, a trimellitate, a phosphate ester, a polyester or a combination thereof. In another preferred embodiment, the plasticizer is a phthalate ester.

In another embodiment, the plasticizer is a phthalate ester of the formula:

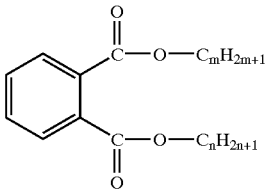

where m is an integer of from 5 to 15 and n is an integer of from 5 to 15. In another embodiment, the phthalate plasticizer is selected from the group consisting of dibutyl phthalate (DBP), dibutoxy ethyl phthalate (DBEP), butyl benzyl phthalate (BBP), butyl octyl phthalate (BOP), dihexyl phthalate (DHP), dioctyl phthalate (DOP), diisooctyl phthalate (DIOP), dicapryl phthalate (DCP), dicapryldioctyl phthalate (DCOP), diisononyl phthalate (DINP), diisodecyl phthalate (DIDP), ditridecyl phthalate, mixtures of these and mixtures of these with other plasticizers.

In another embodiment of the invention, the plasticizer is a diisonyl phthalate plasticizer, a dioctyl phthalate plasticizer or a mixture thereof. In another embodiment of the invention, the plasticizer is a predominantly linear phthalate plasticizer based upon C7, C9 and C11 alcohols and having the formula:

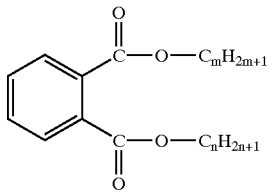

where each of m and n is an integer selected from 7, 9 and 11. An example of such a plasticizer is PALATINOL 711, which is a proprietary plasticizer commercially available from BASF Corporation (Mount Olive, N.J.).

Dibasic acid esters used as plasticizers according to the present invention can be selected, for example, from the group consisting of adipate esters, azelate esters, sebecate esters, and mixtures of these. Adipate esters can be selected, for example, from the group consisting of dioctyl adipates (DOA), diisononyl adipate (DINA), diisodecyl adipate (DIDA) and mixtures of these. The azelate esters can be selected, for example, from the group consisting of dioctyl azelate (DOZ), diisooctyl azelate (DIOZ), di-n-hexyl azelate and mixtures of these. When sebecate esters are used, dibutyl sebecate, dioctyl sebecate, dibenzyl sebecate, butyl benzyl sebecate and mixtures of these can be selected.

Phosphate esters used as plasticizers according to the present invention can be selected, for example, from the group consisting of tricresyl phosphate, cresyl diphenyl phosphate, octyl diphenyl phosphate and mixtures of these.

It is also contemplated that glycol benzoates, glycol butyrates, citrates, isophthalates, and aliphatic and aromatic hydrocarbons and chlorinated hydrocarbons may also be used alone or in combination with plasticizers selected in accordance with the invention.

A coating composition in accordance with the invention can also contain other constituents as are known and available, including: heat stabilizers; light stabilizers; ultraviolet (UV) light absorbers; solvents and diluents, such as, for example, methyl ethyl ketone, mineral spirits, or the like; wetting agents; matting agents; inorganic or carboneous fillers such as, for example, clay and limestone; viscosity improvers; anti-oxidants; bacteriostats and bactericides; surfactants; optical brighteners; tinting and/or toning agents and many other conventional and well known additives and agents.

In one embodiment, a coating composition is provided that includes a wetting agent. The wetting agent can include, for example and without limitation, a salt of unsaturated polyamine amides and higher molecular weight acidic esters and/or a salt of long chain polyamine amides and a polar acidic ester. One preferred wetting agent that may be used in accordance with the invention is a salt of unsaturated polyamine amides and higher molecular weight acidic esters identified as ANTI-TERRA-U 80, commercially available from BYK-Chemie USA, Inc. (Wallingford, Conn.). It is, of course, not intended that the invention be limited to this wetting agent, it being understood that a wide variety of wetting agents may be used, and it is within the purview of a person of ordinary skill in the art to select other wetting agents for use in accordance with the invention. Another example of a wetting agent that can be used in certain embodiments is BYK-P 104S, which is commercially available from BYK-Chemie, USA, Inc. (Wallingford, Conn.).

In another embodiment, a coating composition is provided that includes a light stabilizer and/or a UV light absorber for protection of the coating, substrate and/or an image under the coating. A wide variety of light stabilizers and UV absorbers are available commercially that may be used in accordance with the present invention. Examples include CHISORB 328, available from Maroon (Westlake, Ohio); NANOX, available from Element is (Fairview Heights, Ill.); and UVINUL 3049, available from BASF Corporation (Mount Olive, N.J.).

In one preferred embodiment, UV protection is provided using a combination of TINUVIN 292, a hindered amine light stabilizer, and TINUVIN 1130, a UV absorber, each of which is available from Ciba Specialty Chemicals Corporation USA (Tarrytown, N.Y.). TINUVIN 292 is reported to include 75–85 percent by weight bis(1,2,2,6,6-pentamethyl-4-piperidinyl)-sebacate; and 15–25 percent by weight 1-(methyl)-8-(1,2,2,6,6-pentamethyl-4-piperidinyl)-sebacate. TINUVIN 1130 is reported to include as its major components polymeric benzotriazole compounds and as a minor component polyethylene glycol. More specifically, TINUVIN 1130 is reported to include 30–45 percent by weight poly(oxy-1,2-ethanediyl),alpha-[3-[3-(2H-benzotriazol-2-yl)-5-(1,1-dimethylethyl)-4-hydroxyphenyl]-1-oxopropyl]-omega-(1,1-dimethylethyl)-4-hydroxyphenyl]-1-oxopropoxy; 40–55 percent by weight poly(oxy-1,2-ethanediyl),alpha-[3-[3-(2H-benzotriazol-2-yl)-5-(1,1-dimethylethyl)-4-hudroxyphenyl]-1-oxopropyl]-omega-hydroxy-; and 10–16 percent by weight poly(oxy-1,2-ethanediyl),alpha-hydro-omega-hydroxy-omega-hydroxy-; It is of course not intended that the invention be limited to UV protection agents listed above, but include others that would occur to a person of ordinary skill in the art, now known or later developed, including for example and without limitation, other polymetric benzotriazole compounds and/or other sebacate compounds.

In other embodiments of the invention, the coating composition includes an additive for providing a matte-type finish to the coating. A flatting agent such as fine silica or diatomaceous earth may be used for conventional purposes to change the gloss and shine of the coating. Useful silica flatting agents are porous particulate materials with an average particle size of from about 3 to about 15 microns. In one embodiment, the flatting agent is an amorphous synthetic silica, such as, for example, SYLOID C 907, which is an amorphous synthetic silica with an organic treatment available from Grace Davison (Columbia, Md.). Another matting agent that can be used is ZEOTHIX 95H, available from J. M. Huber Havre De Grace, Md.). It is within the purview of a person of ordinary skill in the art to select a suitable flatting agent from a wide variety of commercial sources. In one embodiment of the invention, the compositions of the present invention include flatting agents in an amount of from about 1% to about 7% by weight, depending upon the gloss desired.

In another embodiment, a coating composition of the present invention also includes a viscosity control agent for regulating and controlling the viscosity of the coating composition to the desired level. Such a viscosity control agent is preferably present in an amount of from about 0.5 to about 3.0 of the composition. Examples of suitable viscosity control agents are aromatic hydrocarbons, aliphatic hydrocarbons and mixtures of these. An example of an aromatic viscosity control agent is a narrow cut aromatic hydrocarbon having a flash point of about 145° F., sold under the trade designation "EXXON A-150." An example of an aliphatic viscosity control agent is a mixture of aliphatic hydrocarbons containing a polysiloxane copolymer sold under the trade designation "BYK 4015" by BYK-Chemie, USA, Inc. (Wallingford, Conn.).

In one aspect of the invention, the coating composition is prepared by homogeneously dispersing polymer particles of emulsion sizes or suspension sizes in a liquid substance comprising a plasticizer as the major component. Other components can be added as desired or necessary, before or after dispersing the polymer particles.

To form the coating composition, a wide variety of mixing techniques may be used, such as techniques known by those skilled in the art for forming a plastisol composition. In general, plastisols are preferably formed by simply mixing the particulate resin material into the plasticizer with sufficient shearing action to ensure a reasonable dispersion of the resin particles in the plasticizer. Preparation of an inventive coating composition can be accomplished using high or low speed mixing techniques. The object of mixing utilized to formulate an inventive coating composition is to obtain a uniform dispersion of the thermoplastic particles in the plasticizer without overheating the mixture. One aspect of such a mixing procedure results in the resin particles being wetted out and, to some degree, swelled and solvated by the plasticizer.

In one preferred aspect of the invention, the coating composition has a viscosity of from about 10,000 to about 300,000 poise as measured by a Brookfield RVT viscometer, 2.5 rpm, spindle #7, at room temperature. In another embodiment, the coating composition has a viscosity of from about 200,000 to about 300,000 poise as measured by a Brookfield RVT viscometer, 2.5 rpm, spindle #7, at room temperature. In another embodiment, the coating composition has a viscosity of about 250,000 poise as measured by a Brookfield RVT viscometer, 2.5 rpm, spindle #7, at room temperature.

The level of the plasticizer used in the coating composition will normally be within the range of from about 30 to about 400 parts by weight per 100 parts by weight of acrylic polymer, more usually from about 50 to about 200 parts by weight of acrylic polymer. Conventional filler materials can be incorporated into the coating composition up to about 400, more usually up to about 200, parts by weight, per 100 parts by weight of acrylic polymer. It is contemplated that the amount of plasticizer used in the compositions of the present invention can vary, depending upon such factors as the desired properties and uses of the composition, the characteristics of the thermoplastic polymer, and the like.

In one embodiment, the coating composition comprises from about 40 to about 50% acrylic polymer and from about 50 to about 60% plasticizer by weight. In another embodiment, the coating composition comprises about 45% acrylic polymer and about 55% plasticizer by weight. In another embodiment, the coating composition comprises about 45% of an acrylic polymer based on n-butyl and methyl methacrylate and about 55% of a phthalate plasticizer by weight, the plasticizer in one embodiment being a linear phthalate plasticizer based upon C7, C9 and C11 alcohols. In another embodiment, the coating composition comprises about 45% DEGALAN 4899-F and about 55% PALATINOL 711 by weight.

In another embodiment of the invention, a coating composition includes an acrylic polymer, a plasticizer and a wetting agent. In another embodiment, the composition includes from about 15 to about 60% acrylic polymer; from about 30 to about 85% phthalate plasticizer; and from about 0.1 to about 3.0 wetting agent, all by weight. In another embodiment, the composition includes from about 25 to about 50% acrylic polymer; from about 40 to about 75% phthalate plasticizer; and from about 0.2 to about 2.0% wetting agent, all by weight. In yet another embodiment, the composition includes from about 35 to about 40% acrylic polymer; from about 40 to about 50% phthalate plasticizer; and from about 0.2 to about 2% wetting agent, all by weight. In still another embodiment, the composition includes about 37.4% acrylic polymer; about 45.6% phthalate plasticizer; and about 0.8% wetting agent, all by weight.

In another embodiment of the invention, a coating composition includes an acrylic polymer based on n-butyl and methyl methacrylate, a linear phthalate plasticizer based upon C7, C9 and C11 alcohols and a wetting agent comprising a salt of unsaturated polyamine amides and higher molecular weight acidic esters. In another embodiment, the composition includes from about 15 to about 60% of an acrylic polymer based on n-butyl and methyl methacrylate; from about 30 to about 85% of a linear phthalate plasticizer based upon C7, C9 and C11 alcohols; and from about 0.1 to about 3.0 of a wetting agent comprising a salt of unsaturated polyamine amides and higher molecular weight acidic esters, all by weight. In another embodiment, the composition includes from about 25 to about 50% of an acrylic polymer based on n-butyl and methyl methacrylate; from about 40 to about 75% of a linear phthalate plasticizer based upon C7, C9 and C11 alcohols; and from about 0.2 to about 2.0% of a wetting agent comprising a salt of unsaturated polyamine amides and higher molecular weight acidic esters, all by weight. In yet another embodiment, the composition includes from about 35 to about 40% of an acrylic polymer based on n-butyl and methyl methacrylate; from about 40 to about 50% of a linear phthalate plasticizer based upon C7, C9 and C11 alcohols; and from about 0.2 to about 2% of a wetting agent comprising a salt of unsaturated polyamine amides and higher molecular weight acidic esters, all by weight. In still another embodiment, the composition includes about 37.4% of an acrylic polymer based on n-butyl and methyl methacrylate; about 45.6% of a linear phthalate plasticizer based upon C7, C9 and C11 alcohols; and about 0.8% of a wetting agent comprising a salt of unsaturated polyamine amides and higher molecular weight acidic esters, all by weight.

In another embodiment of the invention, a coating composition includes DEGALAN 4899F acrylic polymer, PALATINOL 711P plasticizer and ANTI-TERRA U 80 wetting agent. In another embodiment, the composition includes from about 15 to about 60% DEGALAN 4899F; from about 30 to about 85% PALATINOL 711P; and from about 0.1 to about 3.0% ANTI-TERRA U 80, all by weight. In another embodiment, the composition includes from about 25 to about 50% DEGALAN 4899F; from about 40 to about 75% PALATINOL 711P; and from about 0.2 to about 2% ANTI-TERRA U 80, all by weight. In yet another embodiment, the composition includes from about 35 to about 40% DEGALAN 4899F; from about 40 to about 50% PALATINOL 711P; and from about 0.2 to about 2% ANTI-TERRA U 80, all by weight. In still another embodiment, the composition includes about 37.4% DEGALAN 4899F; about 45.6% PALATINOL 711P; and about 0.8% ANTI-TERRA U 80, all by weight.

In another embodiment, a coating composition includes an acrylic polymer, a plasticizer, a wetting agent, a UV absorber and a light stabilizer. In another embodiment, the composition includes from about 15 to about 60% acrylic polymer; from about 30 to about 85% phthalate plasticizer; from about 0.1 to about 3.0% wetting agent; from about 4.5 to about 13.5% UV absorber; and from about 2.5 to about 13.5% light stabilizer, all by weight. In another embodiment, the composition includes from about 25 to about 50% acrylic polymer; from about 40 to about 75% phthalate plasticizer; from about 0.2 to about 2.0% wetting agent; from about 4.5 to about 10.5% UV absorber; and from about 2.5 to about 10% light stabilizer, all by weight. In yet another embodiment, the composition includes from about 35 to about 40% acrylic polymer; from about 40 to about 50% phthalate plasticizer; from about 0.2 to about 2% wetting agent; from about 7 to about 10% UV absorber; and from about 3 to about 5% light stabilizer, all by weight. In still another embodiment, the composition includes about 37.4% acrylic polymer; about 45.6% phthalate plasticizer; about 0.8% wetting agent; from about 7.5 to about 9% UV absorber; and from about 3.7 to about 4.5% light stabilizer, all by weight.

In another embodiment, a coating composition includes an acrylic polymer based on n-butyl and methyl methacrylate, a linear phthalate plasticizer based upon C7, C9 and C11 alcohols, a wetting agent comprising a salt of unsaturated polyamine amides and higher molecular weight acidic esters, a polymetric benzotriazole UV absorber and sebacate light stabilizer. In another embodiment, the composition includes from about 15 to about 60% of an acrylic polymer based on n-butyl and methyl methacrylate; from about 30 to about 85% of a linear phthalate plasticizer based upon C7, C9 and C11 alcohols; from about 0.1 to about 3.0% of a wetting agent comprising a salt of unsaturated polyamine amides and higher molecular weight acidic esters; from about 4.5 to about 13.5% of a polymetric benzotriazole UV absorber; and from about 2.5 to about 13.5% of a sebacate light stabilizer, all by weight. In another embodiment, the composition includes from about 25 to about 50% of an acrylic polymer based on n-butyl and methyl methacrylate; from about 40 to about 75% of a linear phthalate plasticizer based upon C7, C9 and C11 alcohols; from about 0.2 to about 2.0% of a wetting agent comprising a salt of unsaturated polyamine amides and higher molecular weight acidic esters; from about 4.5 to about 10.5% of a polymetric benzotriazole UV absorber; and from about 2.5 to about 10% of a sebacate light stabilizer, all by weight. In yet another embodiment, the composition includes from about 35 to about 40% of an acrylic polymer based on n-butyl and methyl methacrylate; from about 40 to about 50% of a linear phthalate plasticizer based upon C7, C9 and C11 alcohols; from about 0.2 to about 2% of a wetting agent comprising a salt of unsaturated polyamine amides and higher molecular weight acidic esters; from about 7 to about 10% of a polymetric benzotriazole UV absorber; and from about 3 to about 5% of a sebacate light stabilizer, all by weight. In still another embodiment, the composition includes about 37.4% of an acrylic polymer based on n-butyl and methyl methacrylate; about 45.6% of a linear phthalate plasticizer based upon C7, C9 and C11 alcohols; about 0.8% of a wetting agent comprising a salt of unsaturated polyamine amides and higher molecular weight acidic esters; from about 7.5 to about 9% of a polymetric benzotriazole UV absorber; and from about 3.7 to about 4.5% of a sebacate light stabilizer, all by weight.

In another embodiment, a coating composition includes DEGALAN 4899F acrylic polymer, PALATINOL 711P plasticizer, ANTI-TERRA U 80 wetting agent, TINUVIN 1130 UV absorber and TINUVIN 292 light stabilizer. In another embodiment, the composition includes from about 15 to about 60% DEGALAN 4899F; from about 30 to about 85% PALATINOL 711P; from about 0.1 to about 3.0% ANTI-TERRA U 80; from about 4.5 to about 13.5% TINUVIN 1130; and from about 2.5 to about 13.5% TINUVIN 292, all by weight. In another embodiment, the composition includes from about 25 to about 50% DEGALAN 4899F; from about 40 to about 75% PALATINOL 711P; from about 0.2 to about 2.0% ANTI-TERRA U 80; from about 4.5 to about 10.5% TINUVIN 1130; and from about 2.5 to about 10% TINUVIN 292, all by weight. In yet another embodiment, the composition includes from about 35 to about 40% DEGALAN 4899F; from about 40 to about 50% PALATINOL 711P; from about 0.2 to about 2% ANTI-TERRA U 80; from about 7 to about 10% TINUVIN 1130; and from about 3 to about 5% TINUVIN 292, all by weight. In still another embodiment, the composition includes about 37.4% DEGALAN 4899F; about 45.6% PALATINOL 711P; about 0.8% ANTI-TERRA U 80; from about 7.5 to about 9% TINUVIN 1130; and from about 3.7 to about 4.5% TINUVIN 292, all by weight.

In another embodiment, coating compositions are prepared that can be applied to a substrate and cured to provide a flat matte finish to a substrate. In this embodiment, the coating composition includes a flatting agent (also referred to herein as a "matting agent"). In one embodiment, a coating composition includes an acrylic polymer, a plasticizer, a wetting agent, a UV absorber, a light stabilizer and a matting agent. In another embodiment, the composition includes from about 15 to about 60% acrylic polymer; from about 30 to about 85% phthalate plasticizer; from about 0.1 to about 3.0% wetting agent; from about 4.5 to about 13.5% UV absorber; from about 2.5 to about 13.5% light stabilizer; and from about 1 to about 6% matting agent, all by weight. In another embodiment, the composition includes from about 25 to about 50% acrylic polymer; from about 40 to about 75% phthalate plasticizer; from about 0.2 to about 2.0% wetting agent; from about 4.5 to about 10.5% UV absorber; from about 2.5 to about 10% light stabilizer; and from about 2 to about 5% matting agent, all by weight. In still another embodiment, the composition includes from about 35 to about 40% acrylic polymer; from about 40 to about 50% phthalate plasticizer; from about 0.2 to about 2% wetting agent; from about 7 to about 10% UV absorber; from about 3 to about 5% light stabilizer; and from about 2 to about 5% matting agent, all by weight. In yet another embodiment, the composition includes about 37.4% acrylic polymer; about 45.6% phthalate plasticizer; about 0.8% wetting agent; about 7.5% UV absorber; about 3.7% light stabilizer; and about 5% matting agent, all by weight.

In another embodiment, the coating composition includes an acrylic polymer based on n-butyl and methyl methacrylate, a linear phthalate plasticizer based upon C7, C9 and C11 alcohols, a wetting agent comprising a salt of unsaturated polyamine amides and higher molecular weight acidic esters, a polymetric benzotriazole UV absorber, sebacate light stabilizer and a flatting agent selected from the group consisting of a fine silica, diatomaceous earth, an amorphous synthetic silica, and an amorphous synthetic silica with an organic treatment. In another embodiment, the composition includes from about 15 to about 60% of an acrylic polymer based on n-butyl and methyl methacrylate; from about 30 to about 85% of a linear phthalate plasticizer based upon C7, C9 and C11 alcohols; from about 0.1 to about 3.0% of a wetting agent comprising a salt of unsaturated polyamine amides and higher molecular weight acidic esters; from about 4.5 to about 13.5% of a polymetric benzotriazole UV absorber; from about 2.5 to about 13.5% of a sebacate light stabilizer; and from about 1 to about 6% of a flatting agent selected from the group consisting of a fine silica, diatomaceous earth, an amorphous synthetic silica, and an amorphous synthetic silica with an organic treatment, all by weight. In another embodiment, the composition includes from about 25 to about 50% of an acrylic polymer based on n-butyl and methyl methacrylate; from about 40 to about 75% of a linear phthalate plasticizer based upon C7, C9 and C11 alcohols; from about 0.2 to about 2.0% of a wetting agent comprising a salt of unsaturated polyamine amides and higher molecular weight acidic esters; from about 4.5 to about 10.5% of a polymetric benzotriazole UV absorber; from about 2.5 to about 10% of a sebacate light stabilizer; and from about 2 to about 5% of a flatting agent selected from the group consisting of a fine silica, diatomaceous earth, an amorphous synthetic silica, and an amorphous synthetic silica with an organic treatment, all by weight. In yet another embodiment, the composition includes from about 35 to about 40% of an acrylic polymer based on n-butyl and methyl methacrylate; from about 40 to about 50% of a linear phthalate plasticizer based upon C7, C9 and C11 alcohols; from about 0.2 to about 2% of a wetting agent comprising a salt of unsaturated polyamine amides and higher molecular weight acidic esters; from about 7 to about 10% of a polymetric benzotriazole UV absorber; from about 3 to about 5% of a sebacate light stabilizer; and from about 2 to about 5% of a flatting agent selected from the group consisting of a fine silica, diatomaceous earth, an amorphous synthetic silica, and an amorphous synthetic silica with an organic treatment, all by weight. In still another embodiment, the composition includes about 37.4% of an acrylic polymer based on n-butyl and methyl methacrylate; about 45.6% of a linear phthalate plasticizer based upon C7, C9 and C11 alcohols; about 0.8% of a wetting agent comprising a salt of unsaturated polyamine amides and higher molecular weight acidic esters; about 7.5% of a polymetric benzotriazole UV absorber; about 3.7% of a sebacate light stabilizer; and about 5% of a flatting agent selected from the group consisting of a fine silica, diatomaceous earth, an amorphous synthetic silica, and an amorphous synthetic silica with an organic treatment, all by weight.

In another embodiment, the coating composition includes DEGALAN 4899F acrylic polymer, PALATINOL 711P plasticizer, ANTI-TERRA U 80 wetting agent, TINUVIN 1130 UV absorber, TINUVIN 292 light stabilizer and SYLOID C 907 matting agent. In another embodiment, the composition includes from about 15 to about 60% DEGALAN 4899F; from about 30 to about 85% PALATINOL 71 1P; from about 0.1 to about 3.0% ANTI-TERRA U 80; from about 4.5 to about 13.5% TINUVIN 1130; from about 2.5 to about 13.5% TINUVIN 292; and from about 1 to about 6% SYLOID C 907, all by weight. In another embodiment, the composition includes from about 25 to about 50% DEGALAN 4899F; from about 40 to about 75% PALATINOL 711P; from about 0.2 to about 2.0% ANTI-TERRA U 80; from about 4.5 to about 10.5% TINUVIN 1130; from about 2.5 to about 10% TINUVIN 292; and from about 2 to about 5% SYLOID C 907, all by weight. In yet another embodiment, the composition includes from about 35 to about 40% DEGALAN 4899F; from about 40 to about 50% PALATINOL 711P; from about 0.2 to about 2% ANTI-TERRA U 80; from about 7 to about 10% TINUVIN 1130; from about 3 to about 5% TINUVIN 292; and from about 2 to about 5% SYLOID C 907, all by weight. In still another embodiment, the composition includes about 37.4% DEGALAN 4899F; about 45.6% PALATINOL 711P; about 0.8% ANTI-TERRA U 80; about 7.5% TINUVIN 1130; about 3.7% TINUVIN 292; and about 5% SYLOID C 907, all by weight.

It is readily understood that one or more of the ingredients in the above formulations can be omitted in certain embodiments of the invention or can be replaced with alternate ingredients as described herein to provide further alternative embodiments of the present invention.

Although it is not intended that the present invention be limited by any theory, it is believed that the dispersed state of the coating composition is maintained at room temperature, but that the polymer particles absorb the plasticizer at high temperatures and are merged or fused. It is therefore desirable that the coating composition be stored and used at a temperature below that which will cause the coating composition to cure prematurely.

As can be appreciated by those of skill in the art, in one embodiment of the invention there has been described a method that includes (1) providing a substrate having an ink layer thereon; (2) applying onto the substrate in a layer a fluid coating composition including a particulate thermoplastic resin and a plasticizer; and (3) heating the composition to a temperature of from about 250° F. to about 400° F., thereby curing the composition to provide a transparent water-impervious coating over the substrate. In another embodiment, the thermoplastic resin is an acrylic polymer hi yet another embodiment, the acrylic polymer is a poly (methyl methacrylate) polymer. In still another embodiment, the acrylic polymer is based on n-butyl and methyl methacrylate. In another embodiment, the plasticizer is a phthalate plasticizer. In yet another embodiment, the plasticizer has the formula:

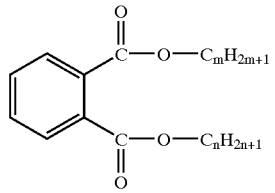

wherein m=7, 9 or 11 and n=7, 9 or 11.

In another embodiment of the invention, the coating composition has a viscosity of from about 10,000 to about 300,000 poise as measured by a Brookfield RVT viscometer, 2.5 rpm, spindle #7, at room temperature. In another embodiment, the coating composition includes a particulate acrylic polymer and from about 30 to about 400 parts phthalate plasticizer by weight per 100 parts by weight of acrylic polymer. In yet another embodiment, the coating composition comprises from about 40 to about 50% acrylic polymer and from about 50 to about 60% plasticizer by weight. In another embodiment, the coating composition further comprises one or more member selected from the group consisting of a heat stabilizer, a light stabilizer, an ultraviolet light absorber, a solvent, a wetting agent, a flatting agent, a filler, an anti-oxidant, a bacteriostat, a bactericide, a surfactant, and an optical brightener.

In another form of the invention, the coating composition includes a wetting agent. In another embodiment, the coating composition comprises from about 15 to about 60% acrylic polymer; from about 30 to about 85% phthalate plasticizer; and from about 0.1 to about 3.0% wetting agent, all by weight. In still another embodiment, the coating composition comprises from about 25 to about 50% acrylic polymer; from about 40 to about 75% phthalate plasticizer; and from about 0.2 to about 2.0% wetting agent, all by weight.

In another form of the invention, the coating composition includes a member selected from the group consisting of a light stabilizer, an ultraviolet light absorber and a mixture thereof. In another embodiment, the coating composition further comprises a wetting agent, a light stabilizer and an ultraviolet light absorber. In yet another embodiment, the coating composition comprises from about 15 to about 60% acrylic polymer; from about 30 to about 85 % phthalate plasticizer; from about 0.1 to about 3.0% wetting agent; from about 4.5 to about 13.5% ultraviolet light absorber; and from about 2.5 to about 13.5% light stabilizer, all by weight. In still another embodiment, the coating composition comprises from about 25 to about 50% acrylic polymer; from about 40 to about 75% phthalate plasticizer; from about 0.2 to about 2.0% wetting agent; from about 4.5 to about 10.5% ultraviolet light absorber; and from about 2.5 to about 10% light stabilizer, all by weight.

In another form of the invention, the coating composition includes a flatting agent. In another embodiment, the flatting agent is selected from the group consisting of silica, diatomaceous earth, amorphous synthetic silica and a mixture thereof. In yet another embodiment, the coating composition further comprises a wetting agent, a light stabilizer, an ultraviolet light absorber and a flatting agent. In still another embodiment, the coating composition comprises from about 15 to about 60% acrylic polymer; from about 30 to about 85% phthalate plasticizer; from about 0.1 to about 3.0% wetting agent; from about 4.5 to about 13.5% ultraviolet light absorber; from about 2.5 to about 13.5% light stabilizer, and from about 1 to about 6% flatting agent, all by weight. In a further embodiment, the coating composition comprises from about 25 to about 50% acrylic polymer; from about 40 to about 75% phthalate plasticizer; from about 0.2 to about 2.0% wetting agent; from about 4.5 to about 10.5% ultraviolet light absorber; from about 2.5 to about 10% light stabilizer, and from about 2 to about 5% flatting agent, all by weight.

In another form of the invention, the coating composition layer is applied by (1) placing a bead of the coating composition on a substrate, and (2) spreading the bead over the substrate. In one embodiment, only a portion of the substrate is covered. In another embodiment, the method further includes texturing the coating composition prior to heating.

In another form of the invention, the coating composition further includes a tinting or toning agent, provided that the tinting or toning agent does not eliminate or substantially impair the transparency of the post-cure coating.

While the invention has been illustrated and described in detail in the foregoing description, the same is to be considered as illustrative and not restrictive in character, it being understood that only the preferred embodiments have been described and that all changes, modifications and equivalents that come within the spirit of the invention as defined by the following claims are desired to be protected.

What is claimed is:

1. A method for avoiding adverse effects of water upon a printed image, comprising:

providing a substrate having a water-soluble ink layer thereon, the ink layer forming a printed image;

applying onto the substrate in a layer a nonaqueous fluid coating composition including a particulate thermoplastic resin and a plasticizer; and heating the composition to a temperature of from about 250° F. to about 400° F., thereby curing the composition to provide a transparent water-impervious coating over the substrate.

2. The method in accordance with claim 1, wherein the thermoplastic resin is an acrylic polymer.

3. The method in accordance with claim 2, wherein the acrylic polymer is a poly(methyl methacrylate) polymer.

4. The method in accordance with claim 2, wherein the acrylic polymer is based on n-butyl and methyl methacrylate.

5. The method in accordance with claim 1, wherein the coating composition has a viscosity of from about 10,000 to about 300,000 poise as measured by a Brookfield RVT viscometer, 2.5 rpm, spindle #7, at room temperature.

6. The method in accordance with claim 1, wherein the plasticizer is a phthalate plasticizer.

7. The method in accordance with claim 6, wherein the plasticizer has the formula:

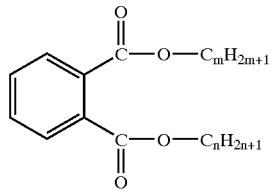

where m=7, 9 or 11 and n=7, 9 or 11.

8. The method in accordance with claim 1, wherein the particulate thermoplastic resin is a particulate acrylic polymer, and wherein the coating composition includes from about 30 to about 400 parts phthalate plasticizer by weight per 100 parts by weight of acrylic polymer.

9. The method in accordance with claim 1, wherein the particulate thermoplastic resin is an acrylic polymer, and wherein the coating composition comprises from about 40 to about 50% acrylic polymer and from about 50 to about 60% plasticizer by weight.

10. The method in accordance with claim 1, wherein the coating composition further comprises one or more member selected from the group consisting of a heat stabilizer, a light stabilizer, an ultraviolet light absorber, a solvent, a wetting agent, a flatting agent, a filler, an anti-oxidant, a bacteriostat, a bactericide, a surfactant, and an optical brightener.

11. The method in accordance with claim 1, wherein the coating composition includes a wetting agent.

12. The method in accordance with claim 11, wherein the coating composition comprises from about 15 to about 60% acrylic polymer; from about 30 to about 85% phthalate plasticizer; and from about 0.1 to about 3.0% wetting agent, all by weight.

13. The method in accordance with claim 11, wherein the coating composition comprises from about 25 to about 50% acrylic polymer; from about 40 to about 75% phthalate plasticizer; and from about 0.2 to about 2.0% wetting agent, all by weight.

14. The method in accordance with claim 1, wherein the coating composition includes a member selected from the group consisting of a light stabilizer, an ultraviolet light absorber and a mixture thereof.

15. The method in accordance with claim 1, wherein the coating composition further comprises a wetting agent, a light stabilizer and an ultraviolet light absorber.

16. The method in accordance with claim 15, wherein the coating composition comprises from about 15 to about 60% acrylic polymer; from about 30 to about 85% phthalate plasticizer; from about 0.1 to about 3.0% wetting agent; from about 4.5 to about 13.5% ultraviolet light absorber; and from about 2.5 to about 13.5% light stabilizer, all by weight.

17. The method in accordance with claim 15, wherein the coating composition comprises from about 25 to about 50% acrylic polymer; from about 40 to about 75% phthalate plasticizer; from about 0.2 to about 2.0% wetting agent; from about 4.5 to about 10.5% ultraviolet light absorber; and from about 2.5 to about 10% light stabilizer, all by weight.

18. The method in accordance with claim 1, wherein the coating composition includes a flatting agent.

19. The method in accordance with claim 18, wherein the flatting agent is selected from the group consisting of silica, diatomaceous earth, amorphous synthetic silica and a mixture thereof.

20. The method in accordance with claim 1, wherein the coating composition further comprises a wetting agent, a light stabilizer, an ultraviolet light absorber and a flatting agent.

21. The method in accordance with claim 20, wherein the coating composition comprises from about 15 to about 60% acrylic polymer; from about 30 to about 85% phthalate plasticizer; from about 0.1 to about 3.0% wetting agent; from about 4.5 to about 13.5% ultraviolet light absorber; from about 2.5 to about 13.5% light stabilizer, and from about 1 to about 6% flatting agent, all by weight.

22. The method in accordance with claim 20, wherein the coating composition comprises from about 25 to about 50% acrylic polymer; from about 40 to about 75% phthalate plasticizer; from about 0.2 to about 2.0% wetting agent; from about 4.5 to about 10.5% ultraviolet light absorber; from about 2.5 to about 10% light stabilizer, and from about 2 to about 5% flatting agent, all by weight.

23. The method in accordance with claim 1, wherein said applying comprises:

placing a bead of the coating composition on a substrate, and spreading the bead over the substrate.

24. The method in accordance with claim 23, wherein only a portion of the substrate is covered.

25. The method in accordance with claim 23, further comprising, after said spreading, texturing the coating composition prior to said heating.

26. The method in accordance with claim 1, wherein the coating composition further includes a tinting or toning agent.

27. The method in accordance with claim 25, wherein said texturing comprises making brush strokes or stucco marks in the coating to impart an original painting appearance to the coating.

* * * * *